US005381835A

United States Patent [19]

Norlin

[11] Patent Number: 5,381,835

[45] Date of Patent: Jan. 17, 1995

[54] WRAP THREAD FEEDING MAGAZINE IN A WEAVING MACHINE

[75] Inventor: Göran Norlin, Fjällgatan, Sweden

[73] Assignee: Texo AB, Almhult, Sweden

[21] Appl. No.: 132,889

[22] Filed: Oct. 7, 1993

[30] Foreign Application Priority Data

Oct. 8, 1992 [SE] Sweden ..... 9202955

[51] Int. Cl.[6] ..... D03D 49/06

[52] U.S. Cl. ..... 139/97; 139/100; 139/101; 242/595.1

[58] Field of Search ..... 139/11 R, 101, 97, 104, 139/102, 21, 25, 24, 23, 425, 100; 28/190, 192; 242/58

[56] References Cited

U.S. PATENT DOCUMENTS

| | | | |
|---|---|---|---|
| 695,983 | 3/1902 | Wilkins | 139/101 |
| 1,322,708 | 11/1919 | Macpherson | 139/101 |
| 1,772,957 | 8/1930 | Moore | 139/101 |
| 1,923,402 | 8/1933 | Thompson | 139/100 |
| 2,133,034 | 10/1938 | Milnes | 139/100 |
| 2,939,489 | 6/1960 | Metzler | 139/104 |
| 3,168,995 | 2/1965 | Ostermann | 139/100 X |
| 3,425,460 | 2/1969 | Carter et al. | 139/100 |

FOREIGN PATENT DOCUMENTS

| | | | |
|---|---|---|---|
| 126789 | 7/1928 | Switzerland | 139/101 |

*Primary Examiner*—Andrew M. Falik

*Attorney, Agent, or Firm*—Pollock, Vande Sande & Priddy

[57] ABSTRACT

A weaving machine for weaving fabric, felts and wires of different widths, comprises a warp thread magazine, first members for feeding warp threads into the weaving machine, and second members for executing the weaving functions in the weaving machine. The warp thread magazine includes a number of warp thread-bearing bobbins which are mounted individually alongside one another and individually selectable so as to form warp thread widths which correspond essentially to the widths of the various fabrics which can be woven in the weaving machine. The first members for feeding the warp threads include feed-in rollers each made up of individually rotatable sections which are arranged alongside one another and cooperate with associated warp thread-bearing bobbins, wherein the feeding-in of the warp threads from selected bobbins can be effected by rotating those sections of the feed-in rollers which cooperate with the selected bobbins.

17 Claims, 4 Drawing Sheets

WRAP THREAD FEEDING MAGAZINE IN A WEAVING MACHINE

FIELD OF THE INVENTION

The present invention relates to a weaving machine for weaving fabric, primarily felts and wires, having different widths, with the weaving machine comprising a warp thread magazine, first members for feeding warp threads into the weaving machine, and second members which execute the weaving functions in the weaving machine.

BACKGROUND OF THE INVENTION

It is already known to weave in one and the same weaving machine felts having, for example, different widths. In weaving of this type use is made of a weaving machine which is fully rigged with warp and has a weave width which corresponds to the maximum weave width of the felt which is to be produced. The warp thread magazine can in this case incorporate so-called flanged bobbins on which the warp threads are wound. Each bobbin can have a width of approximately 250 mm. In previously known equipment it has been proposed to thread up the flanged bobbins on a common warp beam which is provided with a longitudinal wedge for bringing together all the bobbins.

As an example of the application of the woven product, mention may be made of a paper machine in which the paper web is conveyed through the machine on different types of woven wires and felts which serve as conveying belts for the paper during the manufacturing process. The felts or the like can in this case be divided into two groups, namely, on the one hand, flat woven felts and, on the other hand, round-woven felts. The flat-woven felts run in the paper machine in the warp thread direction and, when weaving such a felt, the weave width is set such that it corresponds to the roller width of the paper machine. The weave length corresponds to the circumference of the roller group in which the felt is to run. In order to produce a continuous conveying belt from a flat-woven felt, some type of coupling arrangement is used.

The round-woven felts run in the paper machine in the weft thread direction and, when weaving such a felt, the weave width is set such that it corresponds to half the circumference of the roller group in which the felt is to run. The weave length corresponds to the roller width of the paper machine. This type of felt is thus woven as a continuous conveying belt and no coupling arrangement is necessary in this case.

The paper machines which are used in various parts of the world have individual designs and operate with different functions. The requirement for offering felts and wires having different widths is thus considerable. In this connection it may be mentioned, among other things, that it should be possible for a number of felts of varying weave width to be produced using the same warp load.

When weaving the types of products in question here, it is necessary to produce in one and the same weaving machine felts and wires having different widths, with the machine being easily adjustable for changing the widths as the delivery sequence demands. In weaving machines proposed to date, it has been suggested that the surplus warp which is not being incorporated in the width of the current felt should be guided alongside the weaving process and removed as waste. This due to the fact that all the bobbins on the warp beam are coordinated from the point of view of rotation and that the unrolling takes place from all the bobbins regardless of the number which are involved in the on-going weaving process or are uncoupled from the weaving process. It has therefore been proposed to set up the warp thread width in accordance with the maximum desired width of the felt which could possibly be woven in the machine. When reductions in the weave width are made in relation to the maximum width, the warp thread waste arises. The reduction in the weave width can, in the types of weaving machines in question here, amount to a total of 50%, that is 25% per machine side. This means that for some felts 50% of the total warp is lost as waste. This waste represents a heavy cost to be borne by felt weavers and the users of the weaving machines, and there is a requirement to make it technically possible to eliminate at least the major part of this wastage. The purpose of the present invention is to solve, among other things, these problems.

The principles used hitherto for warp thread magazines and feeding of warp thread into weaving machines have meant, among other things, that all co-rotating bobbins must be wound with the same winding force and have the same diameter for the warp threads. It is desirable that this need for mutual correspondence be eliminated or substantially reduced. The present invention solves this problem too.

In previously used weaving machines, the bobbin stand has been very complicated from the mechanical point of view, using a common warp beam which has required large driving gear boxes, interior support bearings, and the like. It is desirable that this mechanical structure be considerably simplified. The invention aims to solve also this problem.

There is also a need to simplify the feeding-in functions in weaving machines. Thus, for example, it should be possible for the feeding-in function to be independent of the pertaining diameters of the bobbins and operate, for example, with a conventional stepping motor drive. The present invention also provides a solution to this problem.

The weaving machines represent a substantial capital investment and it may, therefore, be advantageous to complement existing weaving machines with the present invention. There is therefore a requirement for it to be possible to complement weaving machines of standard configuration and known designs with the equipment according to the present invention. This problem is also solved by the present invention.

SUMMARY OF THE INVENTION

The feature which may principally be regarded as characterizing the invention is, among other things, that the warp thread magazine comprises a number of warp thread-bearing bobbins which are mounted individually alongside one another and are individually selectable in each weaving case so as to permit the formation of warp thread widths which correspond essentially to the widths of the different felts, wires, and the like, which can be woven in the machine. Further characteristics are that the first members which feed-in the warp threads comprise feed-in rollers (those with a rubber covering) in each case made up of rotatable sections which are arranged alongside one another and which are assigned to warp thread magazine bobbins. Finally, in the present invention the warp threads can be fed in from bobbins engaged in each particular case by rotating those sections of the forwarding rollers which can cooperate with the engaged bobbins.

In further developments of the inventive concept, each bobbin is mounted in a bobbin board in such a way that it can roll essentially freely in relation to other bobbins. Each bobbin can be mounted with each of its gables on at least two supporting rollers situated at a distance from one another. These supporting rollers are in turn mounted rotatably on bars or corresponding elements. The supporting rollers are essentially fixed in the longitudinal directions of the bars or elements, or rather in the common axial directions of the bobbins. The supporting rollers and the bars or elements are preferably arranged such that each bobbin can be rolled in from a position behind or at the side of the weaving machine to its position on the supporting rollers in such a way that they can then execute their unrolling function in the feeding-in of warp thread.

In a preferred embodiment, each feed-in roller consists of one or more sections arranged in a fixed manner in relation to the body of the roller, and one or more sections which can be disconnected from rotation in relation to the body and the fixed section or sections. In other words, the disconnectable sections can be arranged stationary while the roller body and the section/sections arranged in a fixed manner thereon rotate or are intermittently rotated. The roller body and the fixed section/sections form part of a rotatable common roller unit. Each disconnectable section is preferably allocated or serves its own single bobbin. Each selectively disconnectable bobbin thus has assigned thereto a unique section on each feed-in roller. In one embodiment of the inventive concept the number of feed-in rollers is three or more.

The section or sections arranged in a fixed manner on the body of the roller are situated in the central parts of the roller, while those sections which can be disconnected from the point of view of rotation are situated at or form the ends of the roller. The number of disconnectable sections can be, for example, 8 to 12, evenly distributed at each roller end. This corresponds to 20–25% of the total length of the roller or width of the weaving machine. The weaving machine widths can be between 15 and 30 meters. Each bobbin can weigh 60 to 70 kg (with warp wound on).

In a further embodiment of the inventive concept, each disconnectable section on each roller can be coupled to the common roller unit by means of activation members, upon whose activation coupling takes place between the common roller unit and the disconnected section. The activation members for several disconnectable sections are preferably arranged in a common control arrangement. The activation members and the connection and disconnection functions can operate, for example by pneumatic means.

In one embodiment, the activation members comprise volume-expanding members, for example, "drum coupling", which undergo volume expansion upon activation and in this way cause each section and the common roller unit to be brought into cooperation and the section to be carried along with the unit in its rotations. Upon deactivation of the volume-expandable members the carrying cooperation, ceases.

In a further embodiment of the present invention, use is made of one or more attachments which are arranged for warp threads coming from bobbins which are not engaged in the on-going weaving process. These warp threads are drawn outside the shuttle races in the second members for executing the weaving functions in the weaving machine. The warp threads which are situated outside the currently selected weave width and even so participate in the activating warp thread output can be led out via diversion members. The quantity of removed and discarded warp thread is substantially reduced in the equipment proposed by the invention. In most weaving cases carried out, only a few threads per side of the finished fabric are lost as waste in accordance with the present invention. However, when setting the weave width cases may arise in which the weave width is so infelicitous that only a few threads from the two outermost bobbins of the engaged bobbins are needed in order to cover the necessary weave width. As an example, it may be perhaps only 5% of each bobbin on the two outer bobbins which is used. In cases of this kind, however, warp can be saved by weaving somewhat asymmetrically in the weaving machine so that the warp thread in the bobbin on one side is saved completely and 10% is removed from the outer bobbin on the other side. In this way the weaving system according to the invention can be arranged so that the maximum wastage is less than one bobbin (250 mm).

A further characteristic feature of the invention is in an embodiment where the winding and diameter of the warp thread in each bobbin are individual and independent of the windings and diameters of the remaining bobbins. In another embodiment of the present invention the warp threads, which come from the individually operating bobbins and which can be fed into the machine by means of engaged sections on the feed-in rollers, cooperate with guide cylinders arranged downstream of the feed-in rollers. The guide cylinders are preferably two in number, of which one guide cylinder or both guide cylinders can be load detected by means of a load cell, co-rotating or stationary, or rotating at a reduced speed during parts of each revolution, and the like. The invention as set out hereinabove can, together with the guide cylinders, form accessory equipment for existing weaving machines which comprise a back rail or back rails, the fixed members, and third members for feeding out finished fabric (felt or wire). This equipment thus forms a basic design of the weaving machine, which can be complemented or extended using the accessory equipment.

A number of advantages are afforded by the features proposed herein above. Among other things, a substantial saving of warp thread is achieved. The warp thread waste in the various settings can be less than one bobbin. The invention makes it possible to dispense with the use of a heavy warp beam and the introduction of the bobbins into the bobbin board becomes extremely simple. There are no requirements for the diameters of the remaining warp thread bobbins to be the same and weaving with bobbins of different diameters is thus possible. Warping of the bobbins can be carried out less carefully. Finished bobbins can be replaced while weaving continues. Feeding in of warp with the feed-in rollers is easy to regulate since the feed-in rollers have a constant diameter. This is to be compared with previous cases in which the feeding-in was dependent on the common diameter of the remaining warp in the bobbins. Changes in weave width can be made extremely simply in the present invention.

When weaving, the warp thread bobbins can therefore be loaded and changed at the beginning of each weave width adjustment if one or more bobbins have been emptied of warp. The bobbins can be rolled onto and off their support rollers in the bobbin board. The warp threads are drawn in via the feed-in rollers and are applied over guide cylinders and beams in a known manner. The number of bobbins which is to correspond to the warp thread width in question is selected and corresponding sections of the feed-in rollers are kept connected or are disconnected in proportion to the warp thread widths. The connection and disconnection is carried out by activation and deactivation of sections of the feed-in rollers. The feed-in rollers with connected sections are advanced in a conventional manner with certain sections being disconnected if appropriate. The warp threads from non-engaged bobbins are untied and kept outside the weaving process (shuttle races). Any small amount of warp thread from engaged bobbins lying outside the chosen weave width is led off for discarding. The warp thread removal from the different bobbins varies by virtue of the fact that different numbers of bobbins are connected for weaving felts of different widths. The bobbins can be replaced and warp-thread knotted during on-going weaving.

BRIEF DESCRIPTION OF THE DRAWING

A presently proposed embodiment of an apparatus having the features characteristic of the present invention will be described hereinbelow with simultaneous reference to the attached drawings, in which.

DETAILED DESCRIPTION OF THE PREFERRED EMBODIMENT(S)

Figure 1:
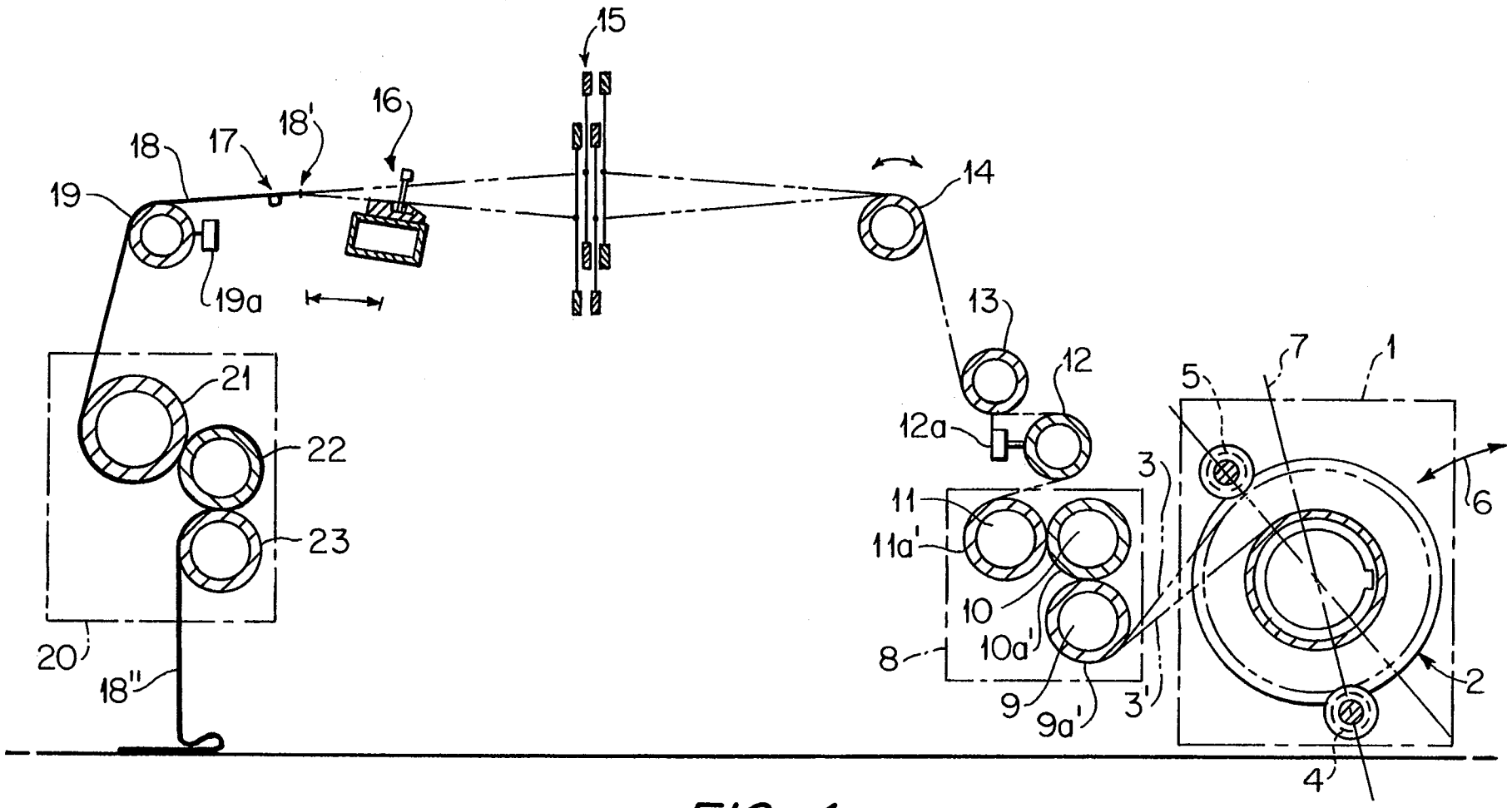
FIG. 1 shows, from the side and in outline form, components forming part of a weaving machine.

The present invention can be used on weaving machines of the TEXO type which are supplied by Almhults Bruk AB, Sweden. In FIG. 1, reference 1 shows a bobbin board for bobbins 2, of which only one is illustrated in FIG. 1. Warp thread 3 is wound onto each bobbin. In the Figure, the warp thread removal from a fully wound bobbin is indicated by 3, while warp thread coming from an almost empty bobbin is shown by 3'. Each bobbin is mounted via its gables on support rollers 4, 5. In this exemplary embodiment, each gable of each bobbin is mounted on two support rollers, and therefore the support rollers for one gable are shown in the figure. Each bobbin can be rolled onto and rolled off the support rollers from and to the rear side of the machine in the direction of the arrows 6. The lowermost supporting roller 4 is arranged along a diameter 7 through the cross-section of the bobbin according to FIG. 1. The second roller is situated to the side of the diameter on the bobbin gable side which is essentially opposite the side for the supporting roller 4. The center distances between the supporting rollers are less than the diameter of the line 7 in order to permit bearing of the bobbin on the supporting rollers. Each bobbin thus lies on four supporting rollers and can rotate freely and individually in relation to other bobbins. This gives, among other things, the advantage that the winding of the warp threads (warping) on the bobbin no longer has to be identical over the whole weaving machine, but it need only be identical within each bobbin, a requirement which is easy to satisfy. From the mechanical point of view the construction of the bobbin stand is extremely simple as compared to existing systems where, in addition to the warp beam, account must also be taken of the large driving gear boxes and interior support bearings, and the like.

In accordance with the present invention, use is also to be made of a roller system 8 which, in the present exemplary embodiment, comprises three feed-in rollers 9, 10 and 11. Each feed-in roller is provided with an elastic covering, for example rubber covering **9*a*, 10*a* and 11*a* in order to permit an expedient clamping of the warp threads which are passed round the feed-in rollers. The warp threads are led in via the lower part of the roller 9 and around this roller and in between the rollers 9 and 10, around the roller 10 and in between the rollers 10 and 11, and from the roller 11. The rollers 9, 10, 11** are driven by a stepping motor drive and feed in the necessary amount of warp required in the weaving machine for each weft therein. Since the rollers have a stepping motor drive, it is simple to reprogram the feeding for different feed-in stretches. Since feeding in is controlled by a roller system and the bobbins, as stated above, are individually rotatable, the diameters of the bobbins are no longer of any importance, which is a considerable advantage in the weaving system according to the present invention.

From the roller 11 the warp threads are passed onward toward guide cylinders 12 and 13 forming part of the invention. A first guide cylinder 12 can either be fixed or rotatably arranged. In the case of a fixed guide cylinder, the feed-in arrangement 8 is unloaded. A load cell function, here indicated by **12*a*, can also be incorporated in the cylinder in order to measure the warp tension during the weaving process. The load cell can be designed and mounted in a known manner and will not be described in any detail here. The first guide cylinder is arranged in relation to the roller 11 in such a way that the warp threads bear approximately on a half turn of the first guide cylinder. The warp thread runs from the first guide cylinder toward the second guide cylinder, and the guide cylinders are in this case arranged in such a way that the warp threads bear on approximately a $\frac{1}{4}$ of the circumference of the second guide cylinder. The second guide cylinder can be fixed or rotatably arranged. In the case of a fixed cylinder, the feed-in arrangement 8** is further unloaded.

From the second guide cylinder the warp threads are led onward toward a back rail 14 of a known type. The back rail 14 can be fixed or rotatably arranged and forms part of the basic design or standard design of the weaving machine together with subsequently described components. The back rail is followed by a shaft mechanism 15 by means of which the pattern formation is effected. Also included are a shuttle race and reed 16 (so-called slay) and a breast beam strip which is used to adjust the height of the woven edge 18' of the woven felt 18. Also included is a breast beam 19 which can be provided with a load cell function **19*a* of a known type for measuring the felt tension during on-going weaving. The breast beam is followed by a cloth beam system 20 with three cloth beams 21, 22 and 23. The cloth beam system determines the thread density of the woven felt 18. After each shuttle passage the material or fabric is drawn forward a predetermined distance. This advance is freely programmable for all thread densities. The product emerging from the weaving system is indicated by 18**".

Figure 2:
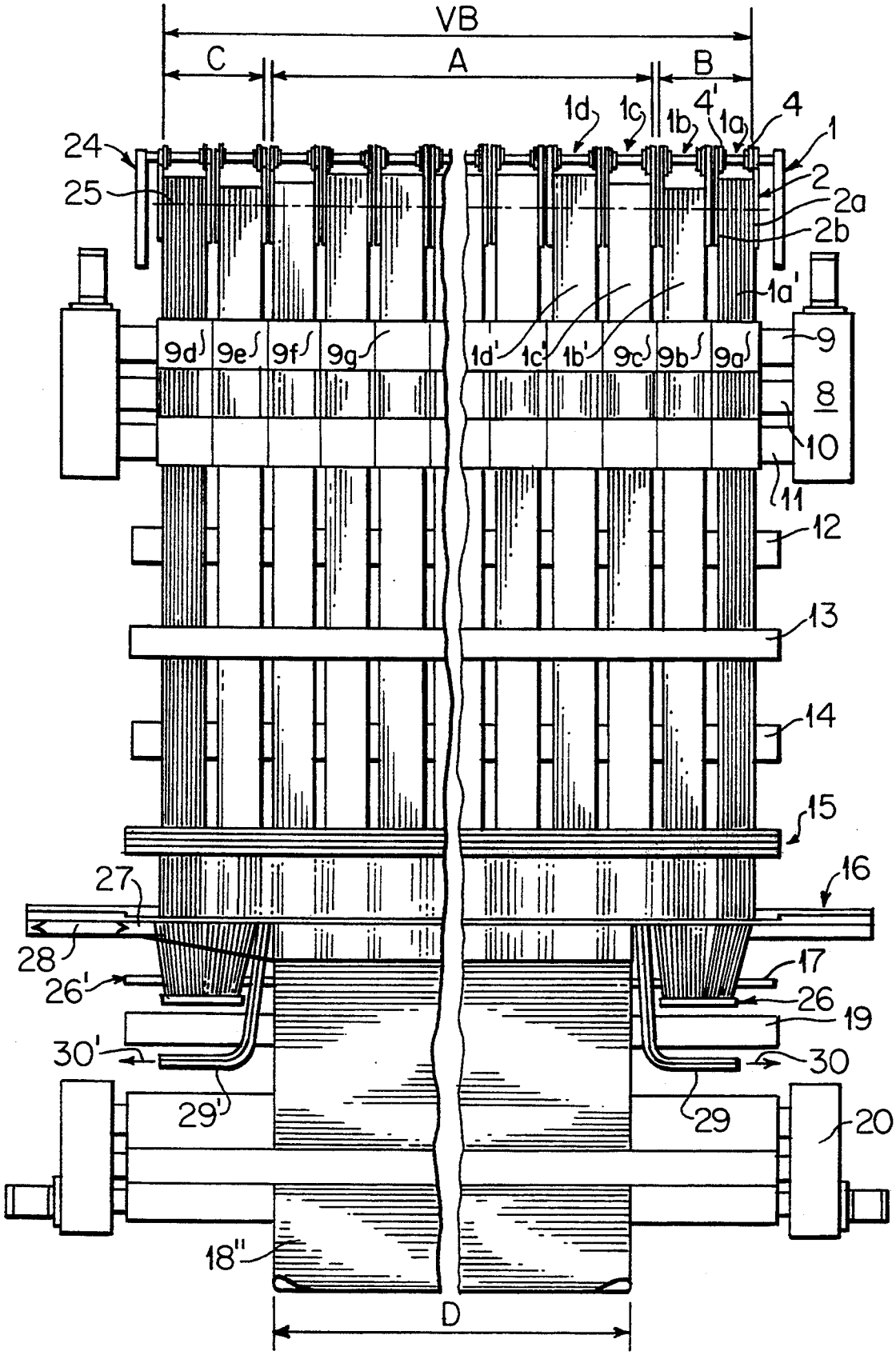
FIG. 2 shows in horizontal view the weaving machine according to FIG. 1.

In FIG. 2, components corresponding to those shown in FIG. 1 have been given the same reference identifications. The bobbin 2 has been shown with its two gables 2*a* and 2*b*. Each gable cooperates with the supporting wheels or the supporting rollers 4 and 4'. For reasons of clarity, the supporting rollers 5 have not been shown. The bobbins are installed in the bobbin board 24 in such a way that the axes of rotation of the bobbins substantially coincide with a common axis of rotation 25. A number of bobbins, for example 60 to 120 bobbins, cover a maximum weave width VB with their outgoing warp threads. In FIG. 2, four bobbins are indicated by 1*a*, 1*b*, 1*c* and 1*d*. The warp threads coming from each bobbin are indicated by 1*a*', 1*b*', 1*c*' and 1*d*', respectively. In accordance with the present invention it should be possible to choose the number of bobbins as a function of a width D of the outgoing felt 18. The bobbins which are not included by the width D in question are kept disconnected from the ongoing weaving process as described hereinbelow.

The bobbins which are to take part in an ongoing weaving as shown in FIG. 2 are accommodated within a space or area A. Thus, disconnected bobbins are situated on both sides of this space or area. The areas for the disconnected bobbins on each side of the space A are indicated by spaces B and C. Thus, in the present weaving case the bobbins 1*a*, 1*b*, are disconnected from the weaving process and the bobbins 1*c* and 1*d* take part in the weaving process. The areas or spaces A, B and C thus vary for different widths D of outgoing fabric 18".

The feed-in rollers 9, 10 and 11 are constructed identically, for which reason only one feed-in roller 9 will be described in detail here. The feed-in roller is made up of a number of sections 9*a*, 9*b*, 9*c*, 9*d*, 9*e*, 9*f* and 9*g*. The middle section 9*g* is longer than the other sections. This middle section 9*g* is moreover fixed to the roller body and at all times rotates with the latter. Each section of the sections 9*a*–9*f* is allocated its own bobbin. Thus, the section 9*a* is allocated bobbin 1*a*, section 9*b* is allocated bobbin 1*b*, section 9*c* is allocated bobbin 1*c*, and each section serves uniquely and only its own bobbin. The section 9*g* serves the bobbin 1*d* together with other bobbins which, together with the section 1*d*, correspond to the minimum weave width D which it is to be possible to weave in the machine. The sections 9*a*–9*f* are arranged in such a way that they can be connected to and disconnected from the body of the roller 9, of which the section 9*g* can thus be regarded as forming part. The bobbins and sections which are not involved in the weaving process are thus disconnected and the warp from these is stationary during the weaving of the cloth 18".

For those warp threads, that is for the warp threads 1*a*', 1*b*' and corresponding warp threads on the other side of the machine (the warp threads which are passed over the sections 9*d* and 9*e*) there are arranged one or more attachments 26, 26'. The attachment or attachments can be of a known type with clamps and holding members (not specially illustrated) for the warp threads. The attachments 26, 26' on both sides of the on-going weave width D are arranged so that the warp threads are kept outside the race 27 for the shuttle/shuttles 28 forming part of the slay function.

Since there is a limit to the extent to which fine division of the bobbin widths can be carried out, cases arise in which warp threads will be lost as waste and discarded. Members 29 and 29' on each side of the fabric 18" are arranged for this waste, which is led off in the directions of the arrows 30 and 30'. As regards the possibility of achieving the least possible wastage of warp threads, reference is made to the description hereinabove.

In the case shown, a round-woven felt 18" is obtained which has a circumference of twice the weave width. Whether a round-woven or flat-woven flat is obtained from the weaving machine depends on the weaving function effected by the shuttle control.

Figure 3:
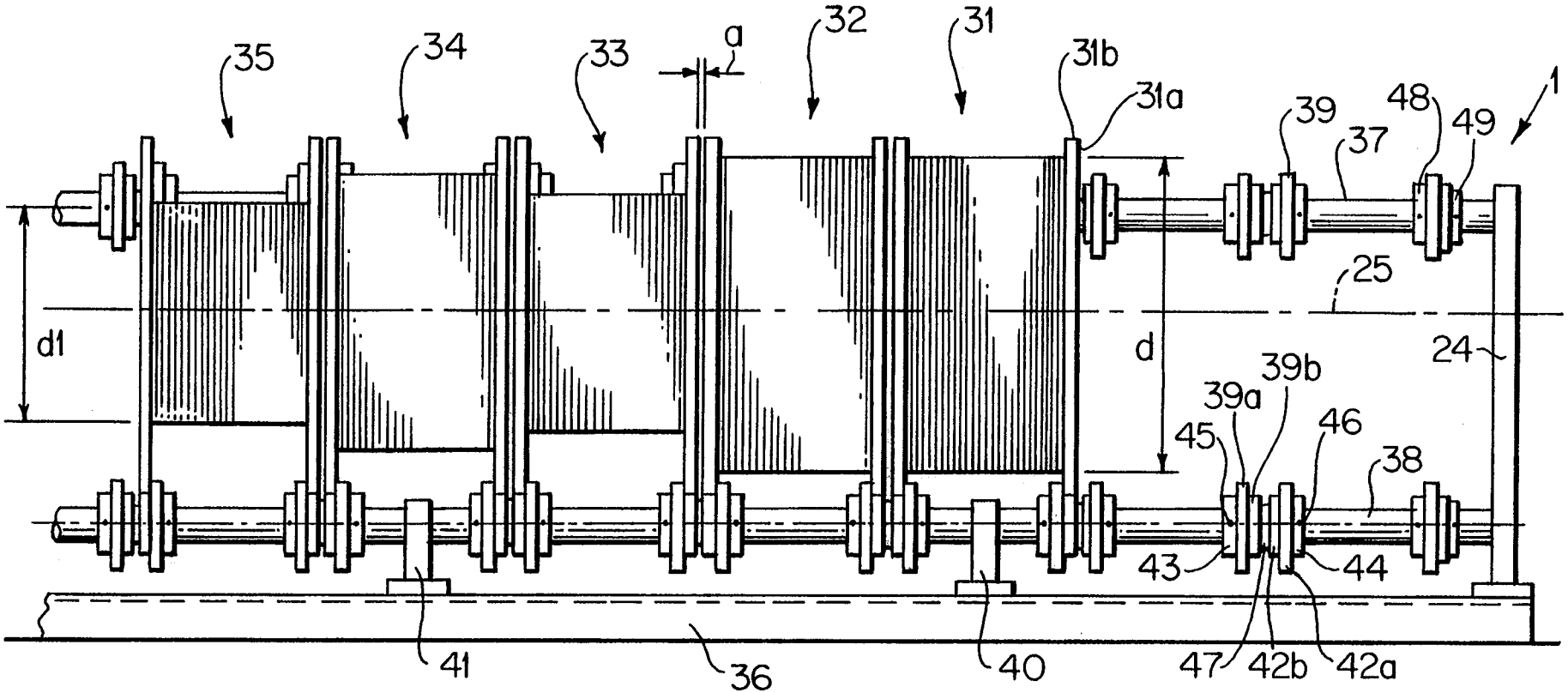
FIG. 3 shows from the rear, a bobbin board used in the weaving machine according to FIGS. 1 and 2, with a number of bobbins inserted.
Figure 4:
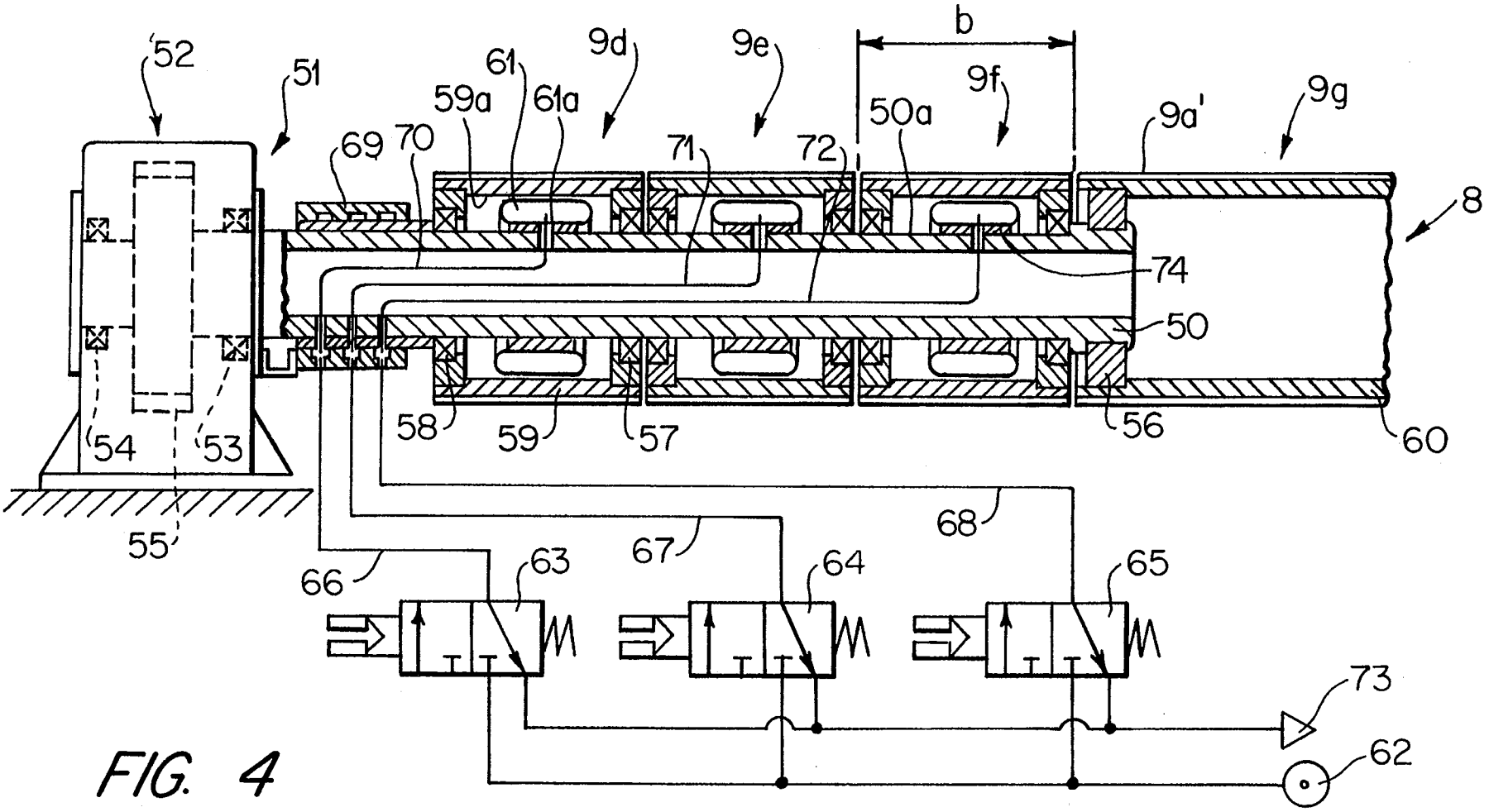
FIG. 4 shows in longitudinal section, parts of a feeding roller with sections which can be disconnected from rotation.

FIG. 3 shows the bobbin board and the bobbins in greater detail. For reasons of clarity, only a part 31, 32, 33, 34 and 35 of the bobbins is shown. The bobbin board consists of a base part or base plate 36 and, arranged thereon, side parts 24 in which bearing rods 37 and 38 for supporting wheels 39 extend parallel to the common axis of rotation 25 of the bobbins. On account of the length of the rods, bearing members 40, 41 are positioned at regular intervals in the longitudinal direction of the lowermost rod 38 which bears the main part of the weight of the bobbins. The upper bearing rod 37 can also be designed with intermediate bearing members of this type. Each supporting wheel or roller is provided with a middle part 39*a* which constitutes a part holding the bobbin in question fixed in the displacement direction along the common axis 25. The part 39 extends inside the gable 31*a*. Each supporting wheel also has a supporting part 39*b* against which the end surface 31*b* of the gable bears and rolls. The supporting wheels are arranged on the rod in pairs, except for the outermost supporting wheels. The supporting roller 42*a*, 42*b* thus forms a pair of with supporting roller 39*a*, 39*b*. These pairs of supporting rollers are fixed in the longitudinal direction of each rod 37, 38 with the aid of parts such as washers 43, 44 which are fixed in the longitudinal direction on each rod by means of locking pins 45, 46. Also arranged between the supporting wheels is a spacer 47 which thus ensures that a distinct space a exists between each supporting roller pair. This space a can be 2 mm, for example. Each of the outermost supporting wheels is fixed in the direction of longitudinal displacement with the aid of parts 48 and 49 in a corresponding manner. The arrangement means that the bobbins are individually and freely rotatable on their associated supporting rollers. The weight with which the bobbins bear against the supporting rollers provides a certain rolling resistance during the process of feeding the warp threads into the weaving machine. This rolling resistance is adapted and used to provide an appropriate feeding of the warp threads into the weaving machine. The parts 43 and 44 can consist of washers, and the supporting rollers 39*a*, 39*b* and 42*a*, 42*b* are designed with through bearing recesses for each bearing shaft 37, 38, which bearing recesses slightly exceed the diameters of the bearing shafts. The bearing arrangement for the supporting rollers is designed in such a way that the supporting rollers have an expedient capacity for swivelling, taking into consideration the appropriate rolling resistance of the bobbins. The warp threads are fed out from the bobbins in a completely diameter-independent manner, and the bobbins can have warp thread diameters d, d1, and the like which differ from each other. FIG. 4 shows the structure of each feeding roller 9, 10, 11. The sections 9*d*, 9*e*, 9*f* and 9*g* are represented in the Figure. The sections 9*d*, 9*e* and 9*f* form the connectable and disconnectable sections, while the section 9*g* is arranged in a fixed manner to a body part 50 which is incorporated in the roller and is mounted at its outer ends, of which one is indicated by 51. The mounting in question is designed with a driving gearbox 52 of a known type. The body part is in the form of an axle and is mounted in the driving gearbox on bearings 53, 54. Also indicated in the figure is a driving wheel 55 which is in gear engagement with a known drive arrangement. Each section has its own rubber surface covering, and all the rubber coverings of the roller sections are symbolized by *9a'*. The section *9g* is fixed securely to the body part 50 via a weld flange 56, to which the section *9g* is welded or made secure on the inside. The connectable and disconnectable sections have in principle the same structure, for which reason the structure of only one section will be described in detail here. Each section is thus mounted on the axle-shaped body part 50 via two ball bearings 57 and 58. Each section comprises a sleeve-shaped part 59 (and 60). The sleeve-shaped section has on the inside a friction surface *59a* for rotation transmission. The body part 50 is provided on its outside *50a* with a volume-expandable member 61 in the form of a tube or corresponding element (for example drum coupling). The inside *61a* of the member 61 is in contact with a pressure source 62 which can be connected via valves 63, 64, 65 of a known type and connections 66, 67 and 68 leading from the valves. The connections are led into the inside of the axle-shaped body part 50 via attachment members 69 on the outside of the body part 50 at the end 51. Arranged inside the body part 50 are connections 70, 71 and 72 which lead from the attachment members to the inner volume *61a* of each volume-expandable member. The system can operate with media of a suitable type, for example air. The valves 63, 64 and 65 operate with two positions, the valves in their first positions connecting the pressure source 62 to each inner volume *61a* and in their second positions connecting the inner volumes *61a* to an outlet channel, sump, and the like, 73. The arrangement described can be of a known type and the transmission between the stationary part 69 and the movable part of the attachment member 69 can be of a known type. The valves can be of a known type and can be controlled in a known manner by the on/off principle. It will be understood in this respect that it is possible, by means of activation members, of which the valves 63, 64 and 65 form part, to connect and disconnect any desired number of connectable and disconnectable sections on the feed-in rollers 9, 10 and 11. Each connectable and disconnectable section on the feed-in roller has a width b corresponding to the bobbin interacting therewith. The feed-in rollers are, in accordance with the above, of identical construction and each section on the roller illustrated in FIG. 4 is placed opposite or cooperates with corresponding sections on other rollers. In FIG. 4, all the sections *9d, 9e* and *9f* are disconnected. Upon expansion of the volume-expanding member 61, contact is achieved between the inner surface of the sleeve 59 and the outer surface *61a* of the member 61. The contact is dependent on the pressure which is supplied from the pressure source 62. This is adapted so that a suitable anchoring is obtained between the rotatable body part 50 and the section in question. The tube 61 or equivalent is secured firmly in a known manner on the outside *50a* of the body part 50 via fixing member 74.

The invention is not limited to the embodiment shown hereinabove by way of example, but can be modified within the scope of the subsequent patent claims and the inventive concept.

I claim:

1. A weaving machine for weaving fabric, felts and wires, having different widths, the weaving machine comprising a warp thread magazine, first members for feeding warp threads into the weaving machine, and second members for executing weaving functions in the weaving machine, the warp thread magazine including a plurality of warp thread-bearing bobbins which are mounted individually alongside one another and selectable so as to form warp thread widths which substantially correspond to the widths of the various fabrics which can be woven in the weaving machine, the first members for feeding the warp threads including feed-in rollers, each feed-in roller including means for being individually rotatable, each feed-in roller including sections which are arranged alongside one another to cooperate with associated warp thread-bearing bobbins, and wherein the feeding-in of the warp threads from selected bobbins is effected by rotating only those sections of the feed-in rollers which cooperate with the selected bobbins.

2. The weaving machine as claimed in claim 1, wherein each bobbin is mounted in a bobbin board substantially freely rotatable in relation to the other bobbins.

3. The weaving machine as claimed in claim 2, wherein each bobbin is mounted through gables on at least two supporting rollers which are situated at a distance from one another, the supporting rollers being rotatably mounted on rods in the longitudinal directions of the rods, the supporting rollers and the rods being arranged such that each bobbin can be rolled into a rolling position on the supporting rollers.

4. The weaving machine as claimed in claim 1, wherein each bobbin is mounted through gables on at least two supporting rollers which are situated at a distance from one another, the supporting rollers being rotatably mounted on rods in the longitudinal directions of the rods, the supporting rollers and the rods being arranged such that each bobbin can be rolled into a rolling position on the supporting rollers.

5. The weaving machine as claimed in claim 4, wherein each feed-in roller section includes at least one fixed section arranged in a fixed manner in relation to a body part of the roller and at least one disconnectable section which can be connected and disconnected, from the point of view of rotation, in relation to the body part and said at least one fixed section, whereby said at least one connectable and disconnectable section can be stationary while the roller body and said at least one fixed section rotate, said roller body and said fixed section forming part of a rotatable common roller unit and wherein each disconnectable section cooperates with an associated bobbin.

6. The weaving machine as claimed in claim 1, wherein each feed-in roller section includes at least one fixed section arranged in a fixed manner in relation to a body part of the roller and at least one disconnectable section which can be connected and disconnected, from the point of view of rotation, in relation to the body part and said at least one fixed section, whereby said at least one disconnectable section can be stationary while the roller body and said at least one fixed section rotate, said roller body and said fixed section forming part of a rotatable common roller unit and wherein each disconnectable section cooperates with an associated bobbin.

7. The weaving machine as claimed in claim 6, wherein said at least one fixed section is situated in the middle part of the roller, and said at least one disconnectable section is situated at or forms the ends of the roller.

8. The weaving machine as claimed in claim 6, wherein said means for being individually rotatable further comprises activation members for connecting each disconnectable section on each roller to the rotatable roller unit to obtain, upon activation, internal coupling between the disconnectable section and said rotatable roller unit and the activation members for several disconnectable sections are arranged in a common control arrangement.

9. The weaving machine according to claim 8, wherein said common control arrangement comprises a plurality of values which upon actuation connect a pressure source to respective disconnectable sections.

10. The weaving machine as claimed in claim 7, wherein said means for being individually rotatable further comprises activation members for connecting each disconnectable section on each roller to the rotatable roller unit, upon whose activation internal coupling is obtained between the disconnectable section and said rotatable roller unit.

11. The weaving machine as claimed in claim 6, wherein said means for being individually rotatable further comprises activation members for connecting each disconnectable section on each roller to the rotatable roller unit, to obtain upon activation internal coupling between the disconnectable section and said rotatable roller unit and wherein the activation members for several disconnectable sections are arranged in a common control arrangement.

12. The weaving machine as claimed in claim 11, wherein the activatable member comprises a volume-expandable member, which undergoes volume expansion upon activation and causes the disconnectable section and the body part to be brought into cooperation and the section to co-rotate with the body part or be advanced with the aid of the latter.

13. The weaving machine as claimed in claim 12, wherein said volume-expandable member is a drum coupling.

14. The weaving machine as claimed in claim 1, further including at least one diversion means for holding warp threads coming from bobbins which are not selected and engaged in an on-going weaving process, to remain outside shuttle races of said second members.

15. The weaving machine as claimed in claim 1, wherein each bobbin is constructed so that the amount of the thread and the diameter of the warp threads wound thereon can be different than those on the other bobbins.

16. The weaving machine as claimed in claim 1, further comprising guide cylinders downstream of the feed-in rollers and load cells such that at least one guide cylinder can be load-detected by said load cells.

17. The weaving machine according to claim 1 wherein said means for being individually rotatable further comprises means for intermittent rotation of said rotatable sections.

* * * * *